US009074363B2

(12) United States Patent
Mullen

(10) Patent No.: US 9,074,363 B2
(45) Date of Patent: Jul. 7, 2015

(54) RESERVOIR

(71) Applicant: David Mullen, Calgary (CA)

(72) Inventor: David Mullen, Calgary (CA)

( * ) Notice: Subject to any disclaimer, the term of this patent is extended or adjusted under 35 U.S.C. 154(b) by 0 days.

(21) Appl. No.: 14/031,874

(22) Filed: Sep. 19, 2013

(65) Prior Publication Data

US 2014/0075852 A1 Mar. 20, 2014

(30) Foreign Application Priority Data

Sep. 19, 2012 (ZA) ..... 2012/07016

(51) Int. Cl.
*E04B 1/343* (2006.01)
*E04H 7/02* (2006.01)

(52) U.S. Cl.
CPC ..... *E04B 1/34321* (2013.01); *E04H 7/02* (2013.01)

(58) Field of Classification Search
CPC ..... B65D 90/24; B65D 90/046; B65D 90/08; B65D 88/128; D65G 90/41; E04H 2004/146; E04H 4/0018; E04H 4/0056; E04H 4/005; E04H 7/02; E04B 1/34321
USPC ..... 52/169.7, 169.8
See application file for complete search history.

(56) References Cited

U.S. PATENT DOCUMENTS

| | | | | | |
|---|---|---|---|---|---|
| 3,409,916 | A * | 11/1968 | Billig et al. | 52/146 |
| 3,439,362 | A * | 4/1969 | Goettl | 52/169.7 |
| 3,501,782 | A * | 3/1970 | Schwarz et al. | 52/169.7 |
| 3,648,303 | A * | 3/1972 | Stewart et al. | 52/5 |
| 4,370,839 | A * | 2/1983 | Blakeway | 52/169.7 |
| 4,550,538 | A * | 11/1985 | Blakeway | 52/169.7 |
| 4,782,538 | A * | 11/1988 | Chisholm et al. | 4/506 |
| 5,713,085 | A * | 2/1998 | Enns | 4/506 |
| 5,882,142 | A * | 3/1999 | Siglin et al. | 405/52 |
| 6,540,201 | B1 * | 4/2003 | Gagnon et al. | 249/139 |
| 6,846,131 | B2 * | 1/2005 | Ianniello et al. | 405/129.3 |
| 6,854,926 | B2 * | 2/2005 | Siglin et al. | 405/52 |
| 7,997,828 | B2 * | 8/2011 | Rijlaarsdam | 405/114 |
| 8,376,167 | B2 * | 2/2013 | Lovelace et al. | 220/4.17 |
| 2012/0309604 | A1 * | 12/2012 | Wiebe | 493/95 |
| 2013/0017018 | A1 * | 1/2013 | Allen et al. | 405/114 |
| 2013/0098910 | A1 * | 4/2013 | Simpson | 220/9.4 |
| 2013/0098911 | A1 * | 4/2013 | Simpson | 220/9.4 |

* cited by examiner

*Primary Examiner* — Elizabeth A Plummer
(74) *Attorney, Agent, or Firm* — Michael Best & Friedrich LLP

(57) ABSTRACT

A reservoir with a foundation formed from ground-engaging segments which surround a base, interengaged vertical wall elements which are mounted to the segments, fasteners which fix the elements to the segments, and a liner which extends over the base and opposed inner surfaces of the elements.

12 Claims, 3 Drawing Sheets

RESERVOIR

BACKGROUND OF THE INVENTION

This invention relates to a reservoir which can be erected on a prepared chosen site, dismantled when required and which can then be transported to a second site for re-erection.

Various applications call for the availability of a reservoir on a temporary basis. For example, certain underground drilling operations need a large quantity of water for a short period. However, once a particular drilling or technical phase has been completed, the water supply is no longer required at one location but, ideally, should be made available for use at a second location which may be quite remote from the first location.

Due to environmental and other constraints the provision of this type of water supply is usually accomplished by erecting a portable reservoir at a first location and, once the requirement for water at the first location no longer exists, moving the reservoir to a second location.

A technique which has been developed to address this requirement is to fabricate a reservoir wall from a plurality of segments which are transported in large pieces and which are lifted and placed in position by means of a crane. A rubber liner is then spread out and fastened to a lip of the wall, whereafter the liner is filled with water. This type of reservoir may be up to 60 m in diameter. During erection and dismantling the liner is prone to damage. Another difficulty is that before the liner can be moved all the water contained in the reservoir must be displaced. This can be tedious. The cost of the liner is high and, if it is torn, it must be replaced. The liner is heavy and a number of workers are required to assist in laying out, and later recovering, the liner. Additionally, when working at sub-zero temperatures, the liner becomes brittle. The liner is then difficult to fold and the problem associated with handling the liner is exacerbated.

An object of the present invention is to provide a reservoir which is readily erected or dismantled.

SUMMARY OF THE INVENTION

The invention provides a reservoir which includes a foundation which surrounds a base area and which comprises a plurality of ground-engaging segments, each segment respectively including at least one recessed formation, a plurality of wall elements, each respective wall element including an upper end, a lower end which is located in at least part of at least one said recessed formation, first and second opposed vertical edges, and respective connecting formations on the first and second edges whereby a first edge of one wall element is connected to a second edge of an adjacent wall element, and a plurality of devices for urging the wall elements downwardly into secure engagement with the recessed formations.

A first fluid-impervious liner may be positioned over the base area overlying each recessed formation. The lower end of each respective wall element may then overlie a portion of the liner in a recessed formation.

In a circumferential direction the wall elements may be reinforced by means of one or more cables or similar flexible elongate members which extend circumferentially around the wall elements.

A gasket may be positioned between each recessed formation and a lower end of each wall element. The gasket may be attached to the lower end of the wall element or may be positioned inside the recess. The devices which urge the wall elements downwardly help to create a sealing effect between the gasket and opposing surfaces of the recessed formation and the lower end of the wall element. This type of sealing arrangement is exemplary only and is non-limiting. An additional seal is provided by the portions of the first liner which extend over the recessed formations (if this technique is used).

Optionally, a second liner may be positioned over the aforementioned first liner. The second liner may extend over the base area and upwardly over an inner surface of each wall element.

In another form of the invention only one liner is used. It is positioned over the base area and covers inner surfaces of the wall elements.

The connecting formations on the vertical edges of each wall element may include seals. The connecting formations and the seals may be configured so that when the reservoir is filled liquid pressure exerted on each wall element, which tends to displace each wall element radially outwardly, is such that the sealing effect of the seals carried by the connecting formations is enhanced.

"Water" is used herein in a broad sense and includes any appropriate liquid. Typically, the liquid is water or an aqueous solution. However, the reservoir of the invention can be used with other liquids e.g. oils or the like. Another possibility is to use the reservoir for the containment of a heap substance which may be solid or in the form of a slurry. For example, the reservoir can be used to contain sand, salt, grain and so on. These applications are exemplary only and are non-limiting.

BRIEF DESCRIPTION OF THE DRAWINGS

The invention is further described by way of example with reference to the accompanying drawings in which.

DESCRIPTION OF PREFERRED EMBODIMENT

In erecting a reservoir in accordance with the principles of the invention a chosen site is first levelled, using appropriate earth-moving machinery and thereafter, if necessary, the site is covered with sand so that a liner, which is to be used in the reservoir, will rest on suitable ground supporting structure. These aspects are known in the art and are not further described herein.

A centre point is designated on the prepared base area and a circle, with a chosen diameter, which is centred on the centre point, is drawn on the sand. The circle which is so drawn provides a reference line along which a wall of the reservoir is erected.

Figure 1:
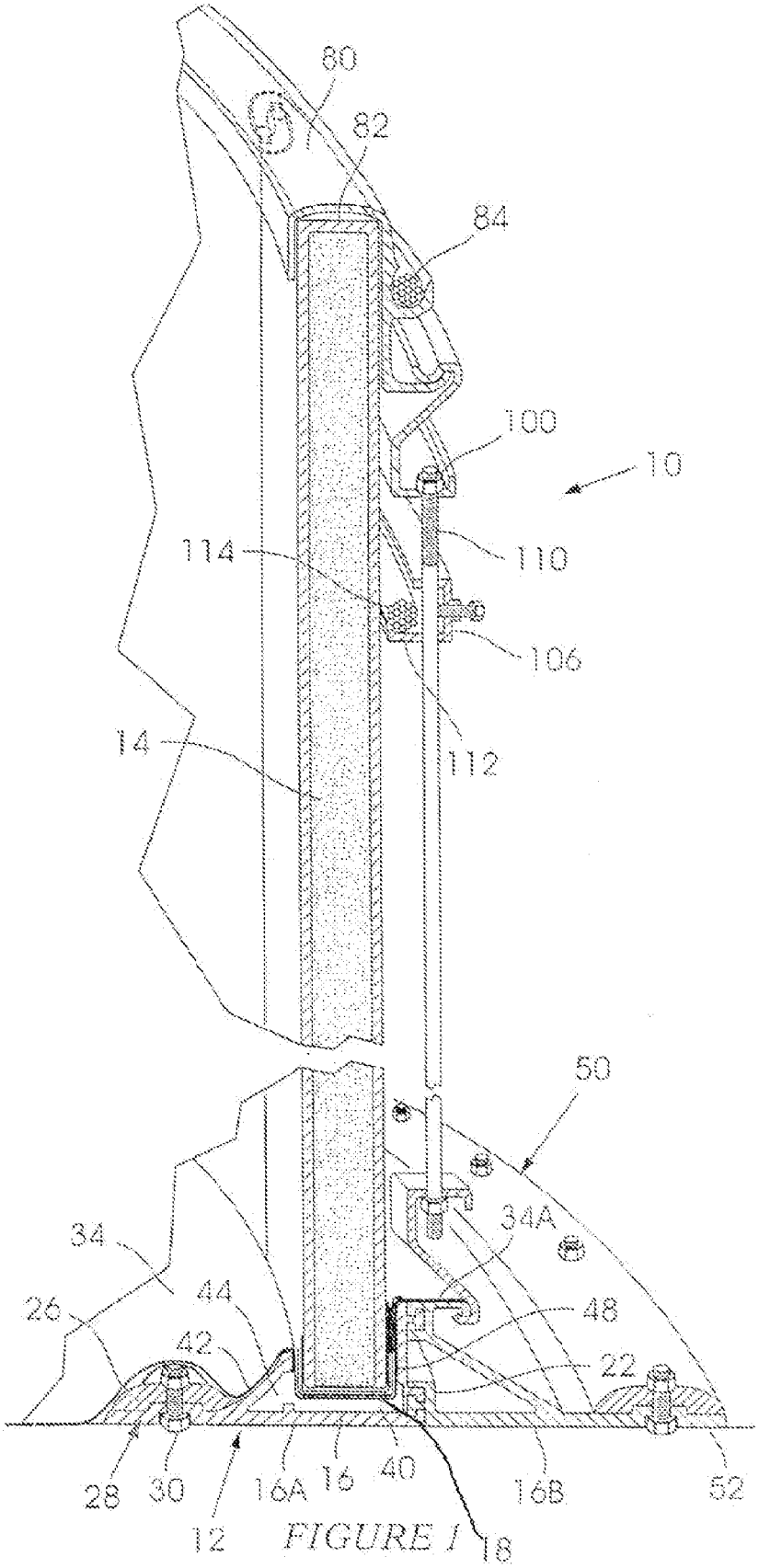
FIG. 1 is a view in cross-section illustrating constructional details of a wall of a reservoir according to the invention.

FIG. 1 illustrates, in cross-section, a wall 10 of a reservoir according to the invention. The wall includes a foundation 12 and a plurality of wall elements 14.

The foundation 12 is formed from a large number of ground-engaging segments 16.

Each segment 16 includes a first component 16A which rests on the ground and which has an upwardly facing recessed formation 18, and a component 16B which is engageable with an outer side of the component 16A by means of complementary interengageable formations 22 formed on the components 16A and 16B respectively. A shaped rubber strip 26 is fixed to an inner, upwardly facing surface 28 of the component 16A by means of fasteners, such as bolts 30, which are located in suitably recessed formations to ensure that no sharp surface is presented to a liner 34 which, subsequently, is used to cover the base area.

The recessed formation 18 carries a first gasket 40 in the form of a shaped seal which is designed to fit closely inside the recessed formation. Engagement of the seal with the recessed formation is accurately accomplished by means of an undercut formation 42 on the component 16A and a complementary formation 44 on the gasket 40. Optionally, a second gasket 48, again in the form of a rubber seal, is positioned overlying the first gasket. An objective in this respect is that the second gasket should ensure that a continuous rubber layer is provided inside the recessed formation 18. In this way the liner 34, when placed in position, does not come into contact with any section of the foundation segments.

The segments are preferably extruded from appropriate aluminium, in lengths and sizes which are manageable and which can be handled by workers. In this way the need for lifting equipment or machinery to carry the foundation segments and then place them in position, or to remove the base segments from an installed location, is minimized.

The component 16B is joined to adjacent components of adjacent segments by means of circumferentially extending connector strips 50 which are bolted, as appropriate, to outer flanges 52 on the components. This is done to provide circumferential reinforcement to the foundation structure.

Once the foundation structure has been assembled it encloses a defined base area on the prepared site, extending along the previously marked circle. The liner 34 is smoothed as far as is possible and is carefully positioned inside the recessed formations 18 overlying the strips 26 and the gaskets 40 and 48. A peripheral edge 34A of the liner extends to a greater or lesser extent outwardly from the recessed formations 18.

Figure 4:
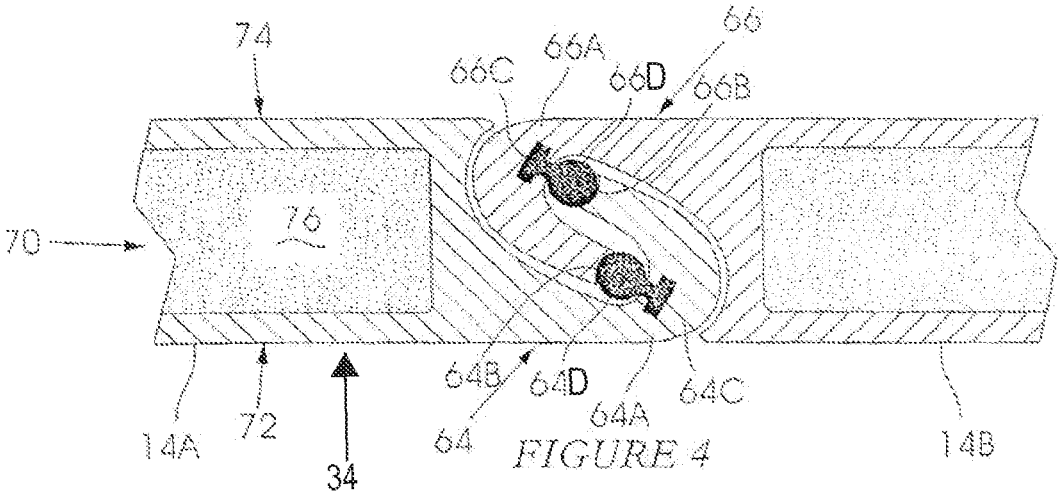
FIG. 4 is a view in cross-section and in plan taken through two adjacent wall elements which form part of the reservoir wall.

The wall elements 14 are assembled in side-by-side abutting relationships with one another, and are engaged with the respective recessed formations 18. Each wall element is rectangular in outline and, viewed from one side, has a lower end 60, an upper end 62, and first and second opposed vertical edges 64 and 66 which are depicted in cross-section on a larger scale and in plan in FIG. 4, which shows the interconnection of two adjacent wall elements 14A and 14B respectively.

Each wall element is formed from an extrusion using appropriate aluminium working techniques. The extrusion defines a hollow 70 of rectangular proportions, an inner wall surface 72 an outer wall surface 74 and first and second shaped vertical sides 64 and 66. The hollow 70 is filled with an appropriate insulation 76. Ideally the insulation is expanding foam which is placed in fluent form, in situ, into the hollow and which, upon setting, fills the hollow and then bonds to surfaces of the hollow. Conveniently the formations are engaged with a hinge-type action in which, initially, the sealing beads do not bear against opposed metal surfaces. However with hinge movement a closer interengagement of the formations 64A and 66A ensues and the sealing beads are, in the process, urged into tight sealing engagement with respective opposing metal surfaces. In this way a beam-type effect is provided which considerably strengthens the wall element.

The vertical side 64 is formed with a curved connecting formation 64A. The vertical edge 66 has a connecting formation 66A which is of complementary shape to the formation 64A. Vertically-extending elongate seals 64B and 66B are engaged with respective undercut formations 64C and 66C to present sealing beads 64D and 66D respectively.

The formations 64A and 66A are engageable with a sliding action, or alternatively with a hinge type action, with each other. A secure mechanical bond is provided in this way between adjacent wall elements. Additionally a double sealing action is provided by the seals at each connection interface.

The length of each wall element, i.e. its dimension in a vertical direction, varies according to requirement but typically lies in the range of from 2 m to 5 m. It is to be borne in mind that it is desirable for a wall element to be of a mass and a size which can be handled with relative ease, if necessary without using lifting equipment. For this reason, the wall elements are modular and are sized so that the weight of each element is such that the element can be handled by one or more workers. Weight reduction is accomplished, apart from size considerations, by the use of structural aluminium and extrusion techniques. The insulation 76 should be foamed to enhance its insulation characteristics but, at the same time, to reduce weight.

The wall elements 14 are interengaged with one another along a circumferential path of circular shape and, in each instance, each wall element has a lower end located in a recessed formation 18.

Figure 2:
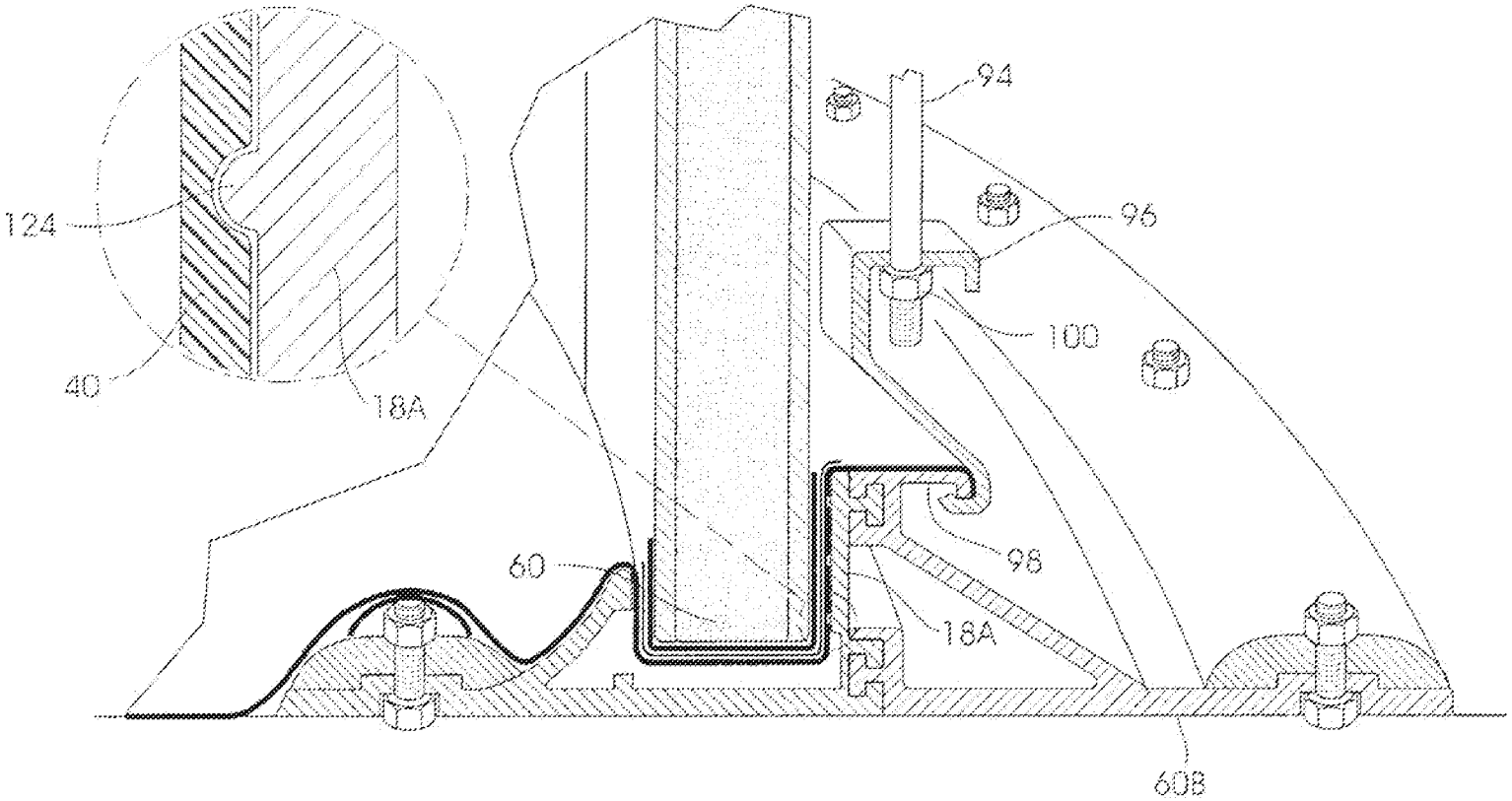
FIG. 2 shows, on a larger scale than in FIG. 1, but also in cross-section, a lower part of a wall of the reservoir.
Figure 3:
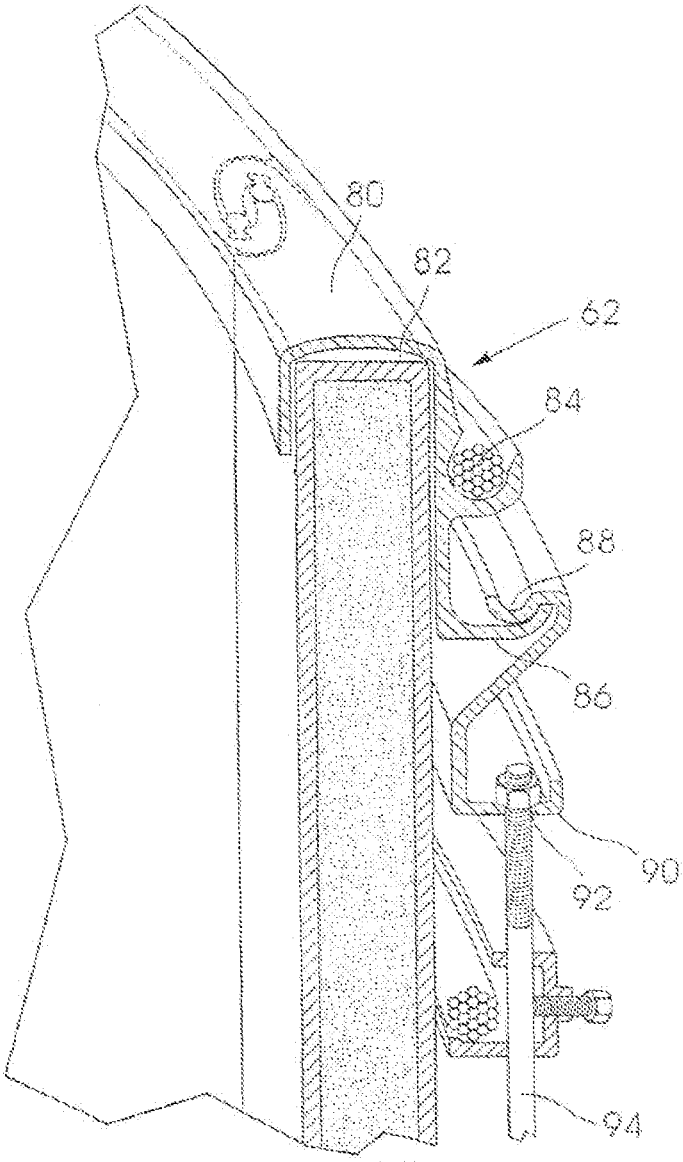
FIG. 3 shows constructional details, in cross-section, prevailing at an upper end of a wall of the reservoir.

To enhance the sealing effect between the lower ends of the wall elements and the recessed formations each wall element should be urged downwardly into tight engagement with the corresponding second gasket 48. Another factor is that, when the reservoir is filled with a liquid, a force is exerted on inner surfaces of the wall elements which tends to move the wall elements radially outwardly. To combat the radial force and to achieve a sealing effect, a top rail 80, formed from an extruded aluminium section, is placed over an upper end 62 of a wall element. The rail has a recess 82 in which a cable 84 is positioned. The cable extends circumferentially around the circular assembly of wall elements and is tensioned, as appropriate, using suitable techniques. The rail has an upwardly facing flange 86 and a hook-shaped hanger component 88 is engaged therewith. This component depends downwardly and, on a lower formation 90, is formed with a plurality of holes 92. An elongate stud 94 is engaged with each respective hole. A lower end of the stud, see FIG. 2, is engaged with a respective hook member 96 which is clipped to a flange 98 of the component 60B. A nut 100 fixed to the stud can be tightened to stress the stud 94 and so urge the wall element firmly into engagement with the corresponding recessed formation, thereby enhancing a seal with the gaskets.

At least one clamp 106 is fixed to each respective stud. The clamp can be moved along the stud and secured in a desired location by means of a screw actuated fastening device 110. The clamp has a flange 112 to which a cable 114 is mounted. The cable 114, is similar to the cable 84, and extends circumferentially around the wall elements and can be tightened as appropriate in order to impart a circumferential loading to the wall elements.

The number of clamps and cables can be varied according to requirement to ensure that the wall elements are adequately reinforced.

An insert drawing to FIG. 2 shows, on an enlarged scale, constructional details within the recessed formation 18. An outer wall 18A of the recessed formation carries a number of protrusions 124, each in the form of a circumferentially extending rib, at spaced vertical intervals from each other. The protrusions create pressure points against the liner and each gasket and help to enhance the sealing effect at this interface.

If required a second liner, not shown, can be positioned over the liner 34. The second liner then covers inner surfaces of the wall elements and extends to the upper ends 62, overlying the rails 80. The use of a second liner is appropriate if the seal between the foundation 16 and the lower ends of the wall elements is suspect or inadequate or if the seal between each set of adjacent wall elements is suspect or inadequate.

Another possibility is not to make use of the first liner 34. Instead use is made of a single liner which is used in the same way as the second liner referred to, which extends over the base and covers inner surfaces of the wall elements, and then extends to and overlies the upper ends 62. The second liner is then secured in position in any appropriate way. This technique would be made use of if conditions are such that the first liner, when clamped between the segments and downwardly urged wall elements, could, in the process, be damaged e.g. by the inclusion of dirt or debris which may be present in the recessed formations 18.

The liner 34 is heavy and, as noted, if the liner is used in sub-zero temperatures it is brittle and difficult to handle. These aspects can be addressed by placing a number of flexible pipes into the sand which extends over the base area of the reservoir. This is done before the liner is put in position. Each pipe is connected to a hot air source, for example an exhaust system of a truck or earth moving machinery or the like. If the pipes terminate near a centre region of the liner then, when the hot air enters the interface between the underlying sand and the liner, an air bubble is created near the centre. This lifts the liner and water on the liner then tends to run towards a peripheral edge of the liner. This helps to remove water from the liner when it is to be taken from the base site. The hot air also raises the temperature of the liner, at least to some extent, and this facilitates the folding of the liner as may be appropriate.

The invention claimed is:

1. A reservoir having a foundation surrounding a base area, the reservoir comprising:

a first ground engaging segment and a second ground engaging segment, each ground engaging segment including a recessed formation;

a first wall element and a second wall element, each wall element including an upper end, a lower end, a first vertical edge extending from the upper end to the lower end, and a second vertical edge opposing the first vertical edge and extending from the upper end to the lower end;

a first stud and a second stud, each stud including an upper end and a lower end; and a first nut and a second nut, wherein the first vertical edge and the second vertical edge of each wall element include a connecting formation, whereby the first wall element and the second wall element form a connection between the connecting formation of the first vertical edge of the first wall element and the connecting formation of the second vertical edge of the second wall element, wherein the lower end of the first wall element is located in at least part of the recessed formation of the first ground engaging segment and the lower end of the second wall element is located in at least part of the recessed formation of the second ground engaging segment, wherein the upper end of the first stud is connected to the upper end of the first wall element and the lower end of the first stud is connected to the first ground engaging segment and the upper end of the second stud is connected to the upper end of the second wall element and the lower end of the second stud is connected to the second ground engaging segment, wherein the first nut is coupled to the first stud to urge the first wall element downwardly into engagement with the recessed formation of the first ground engagement segment to form a first seal between the lower end of the first wall element and the recessed formation of the first ground engagement segment, and wherein the second nut is coupled to the second stud to urge the second wall element downwardly into engagement with the recessed formation of the second ground engagement segment to form a second seal between the lower end of the second wall element and the recessed formation of the second ground engagement segment.

2. The reservoir according to claim 1, further comprising a fluid-impervious liner which extends into the recessed formation of each of the ground engagement segment, and wherein the lower end of each wall element then overlies a section of the liner in the recessed formation of each of the ground engagement segment.

3. The reservoir according to claim 1, further comprising at least one elongate member which extends circumferentially around the first wall element and the second wall element, and wherein the first wall element and the second wall element are circumferentially loaded by means of the at least one elongate member.

4. The reservoir according to claim 3, wherein the at least one elongate member is a cable.

5. The reservoir according to claim 1, further comprising a gasket positioned between each recessed formation and the lower end of each wall element.

6. The reservoir according to claim 1, further comprising a liner positioned over the base area and covers inner surfaces of each wall element.

7. The reservoir according to claim 1, wherein the connecting formation includes seals, whereby the connection between the first wall element and the second wall element is configured so that when the reservoir is filled, liquid pressure exerted on each wall element, which tends to displace each wall element radially outward, is such that a sealing effect of the seals carried by each connecting formation in the connection, is enhanced.

8. The reservoir according to claim 1, wherein each wall element has a hollow which is filled with insulation.

9. The reservoir according to claim 1, wherein the connecting formation includes a curved portion, a seal extending from the upper end to the lower end of each wall element, and an undercut formation shaped to correspond to an end section of the seal.

10. The reservoir according to claim 9, wherein the seal is positioned at an end of the curved portion and the undercut formation is positioned in an inner section of the curved portion.

11. The reservoir according to claim 9, whereby the seal of the connecting formation of the first vertical edge of the first wall element engages the undercut formation of the connecting formation of the second vertical edge of the second wall element.

12. The reservoir according to claim 11, whereby the seal of the connecting formation of the second vertical edge of the second wall element engages the undercut formation of the connecting formation of the first vertical edge of the first wall element.

* * * * *